US006154103A

United States Patent [19]

Scharen et al.

[11] Patent Number: 6,154,103

[45] Date of Patent: Nov. 28, 2000

[54] PUSH ON CONNECTOR FOR CRYOCABLE AND MATING WELDABLE HERMETIC FEEDTHROUGH

[75] Inventors: Michael J. Scharen; Wallace Kunimoto, both of Santa Barbara; Angela May Ho, Buellton, all of Calif.

[73] Assignee: Superconductor Technologies, Inc., Santa Barbara, Calif.

[21] Appl. No.: 09/173,339

[22] Filed: Oct. 15, 1998

Related U.S. Application Data

[63] Continuation-in-part of application No. 08/638,321, Apr. 26, 1996, Pat. No. 5,856,768, which is a continuation of application No. 08/227,974, Apr. 15, 1994, abandoned.

[51] Int. Cl.[7] ..... H01P 1/04

[52] U.S. Cl. ..... 333/99 S; 333/260; 505/210; 505/704; 505/706; 505/866

[58] Field of Search ..... 333/995, 260; 505/210, 700, 704, 706, 866

[56] References Cited

U.S. PATENT DOCUMENTS

| | | | |
|---|---|---|---|
| 3,263,193 | 7/1966 | Allen et al. | 505/866 |
| 3,686,624 | 8/1972 | Napoli et al. | 333/238 X |
| 4,487,999 | 12/1984 | Baird et al. | 333/260 |
| 4,724,409 | 2/1988 | Lehman | 333/260 |
| 4,737,601 | 4/1988 | Gartzke | 174/152 |
| 5,120,705 | 6/1992 | Davidson et al. | 333/99 S |
| 5,508,666 | 4/1996 | Nguyen | 333/260 |
| 5,563,562 | 10/1996 | Szwec | 333/260 |
| 5,576,675 | 11/1996 | Oldfield | 333/260 |
| 5,856,768 | 1/1999 | Hey-Shipton et al. | 333/260 X |

FOREIGN PATENT DOCUMENTS

| | | |
|---|---|---|
| 26 09 076 A1 | 9/1977 | Germany . |
| 1171244 | 10/1989 | Japan . |

*Primary Examiner*—Benny T. Lee
*Attorney, Agent, or Firm*—Lyon & Lyon LLP

[57] ABSTRACT

An electrical interconnect provides a path between cryogenic or cryocooled circuitry and ambient temperatures. As a system, a cryocable 10 is combined with a trough-line contact or transition 20. In the preferred embodiment, the cryocable 10 comprises a conductor 11 disposed adjacent an insulator 12 which is in turn disposed adjacent another conductor 13. The components are sized so as to balance heat load through the cryocable 10 with the insertion loss. In the most preferred embodiment, a coaxial cryocable 10 has a center conductor 11 surrounded by a dielectric 12 (e.g. Teflon™) surrounded by an outer conductor 13 which has a thickness between about 6 and 20 microns. The heat load is preferably less than one Watt, and most preferably less than one tenth of a Watt, with an insertion loss less than one decibel. In another aspect of the invention, a trough-line contact or transition 20 is provided in which the center conductor 11 is partially enveloped by dielectric 12 to form a relatively flat portion 28. The preferred overall geometry of the preferred embodiment of the cable is generally cylindrical, although other geometries are possible (e.g., stripline, microstrip, coplanar or slotline geometries). In a further aspect of the present invention, a push-on connector 120 is provided to facilitate connection and disconnection of the cryocable from an HTS circuit and/or a mating feedthrough 124.

18 Claims, 11 Drawing Sheets

PUSH ON CONNECTOR FOR CRYOCABLE AND MATING WELDABLE HERMETIC FEEDTHROUGH

This is a continuation-in-part of application Ser. No. 08/633,321 issued on Jan. 5, 1999, filed on Apr. 26, 1996, U.S. Pat. No. 5,856,768, which is a file wrapper continuation of application Ser. No. 08/227,974, filed on Apr. 15, 1994, now abandoned. The priority of these prior applications is expressly claimed and their disclosures are hereby incorporated by reference herein in their entirety.

FIELD OF THE INVENTION

The present invention relates to signal interfaces, particularly coaxial cables and cable-to-circuit transitions (i.e., interconnects) which may preferably be used to interface cryogenic components and ambient-environment components which are at temperature differences of about 50–400 K (or ° C.). The invention is particularly useful in microwave or radio frequency applications of cold electronics or circuits which include high temperature superconductor material.

BACKGROUND OF THE INVENTION

There are many benefits to having circuitry that includes superconductive material. Superconductivity refers to that state of metals and materials in which the electrical resistivity is zero when the specimen is cooled to a sufficiently low temperature. The temperature at which a specimen undergoes a transition from a state of normal electrical resistivity to a state of superconductivity is known as the critical temperature ("$T_c$"). The use of superconductive material in circuits is advantageous because of the elimination of resistive losses.

Until recently, attaining the $T_c$ of known superconducting materials required the use of liquid helium and expensive cooling equipment. However, in 1986 a superconducting material having a $T_c$ of 30 K was announced. See, e.g., Bednorz and Muller, Possible High $T_c$ Superconductivity in the Ba—La—Cu—O System, Z. Phys. B-Condensed Matter 64, 189–193 (1986). Since that announcement superconducting materials having higher critical temperatures have been discovered. Collectively these are referred to as high temperature superconductors (HTSs). Currently, superconducting materials having critical temperatures in excess of the boiling point of liquid nitrogen, 77 K (i.e., about −196° C. or −321° F.) at atmospheric pressure, have been disclosed.

HTSs have been prepared in a number of forms. The earliest forms were preparation of bulk materials, which were sufficient to determine the existence of the superconducting state and phases. More recently, thin films on various substrates have been prepared which have proved to be useful for making practical superconducting devices. More particularly, the applicant's assignee has successfully produced thin film thallium superconductors which are epitaxial to the substrate. See, e.g., Olson, et al., Preparation of Superconducting TlCaBaCu Thin Films by Chemical Deposition, Appl. Phys. Lett. 55, No. 2, 189–190 (1989), incorporated herein by reference. Techniques for fabricating and improving thin film thallium superconductors are described in the following patent and copending applications: Olson, et al., U.S. Pat. No. 5,071,830, issued Dec. 10, 1991; Controlled Thallous Oxide Evaporation for Thallium Superconductor Films and Reactor Design, U.S. Pat. No. 5,139,998, issued Aug. 18, 1992; In Situ Growth of Superconducting Films, Ser. No. 598,134, filed Oct. 16, 1990 now abandoned; and Passivation Coating for Superconducting Thin Film Device, Ser. No. 697,660, filed May 8, 1991 now abandoned, all incorporated herein by reference.

High temperature superconducting films are now routinely manufactured with surface resistances significantly below 500 $\mu\Omega$ measured at 10 GHz and 77 K. These films may be formed into circuits. Such superconducting films when formed as resonant circuits have an extremely high quality factor ("Q"). The Q of a device is a measure of its lossiness or power dissipation. In theory, a device with zero resistance (i.e., a lossless device) would have a Q of infinity. Superconducting devices manufactured and sold by applicant's assignee routinely achieve a Q in excess of 15,000. This is high in comparison to a Q of several hundred for the best known non-superconducting conductors having similar structure and operating under similar conditions.

A benefit of circuits including superconductive materials is that relatively long circuits may be fabricated without introducing significant loss. For example, an inductor coil of a detector circuit made from superconducting material can include more turns than a similar coil made of non-superconducting material without experiencing a significant increase in loss as would the non-superconducting coil. Therefore, a superconducting coil has increased signal pick-up and is much more sensitive than a non-superconducting coil.

Another benefit of superconducting thin films is that resonators formed from such films have the desirable property of having very high-energy storage in a relatively small physical space. Such superconducting resonators are compact and lightweight.

Although circuits made from HTSs enjoy increased signal-to-noise ratios and Q values, such circuits must be cooled to below $T_c$ temperatures (e.g. typically to 77 K or lower). In addition, it is desirable to directly interface or connect these cooled HTS circuits to other components or devices that might not be cooled. Most particularly, the signals from the cooled circuits often must be coupled to electronics at ambient temperatures.

Furthermore, low temperatures must be maintained when using cryo-cooled electronics and infrared detectors. In such situations an interface to couple signals between cooled and ambient temperatures is needed.

Generally, coaxial cables are used as signal interfaces. Coaxial cables are typically made of a central signal conductor (i.e., a center or inner conductor) covered with an insulating material (e.g., dielectric) which, in turn, is covered by an outer conductor. The entire assembly is usually covered with a jacket. Such a cable is "coaxial" because it includes two axial conductors that are separated by a dielectric core.

Although coaxial cables are generally used as signal interfaces, when connecting circuits which include HTS material, one end of the connecting coaxial cable might be in contact with a circuit cooled to 77 K, and the other end might be in contact with a device at a much higher temperature (e.g., room ambient temperature is about 300 K). Standard coaxial cables are not manufactured to operate under such conditions. When standard coaxial cables are used under such conditions, the signal losses may be quite high and the heat load by thermal conduction through the cable may be quite large.

Minimizing signal losses is important because the ability to transmit signals directly affects the sensitivity and accuracy of the devices. Insertion loss is a measure of such losses due to intermediary components. In equation form, if the output wattage of a circuit is $P_1$ without intermediary components and $P_2$ with intermediary components respectively, then the insertion loss L is given by the formula $$L\ (dB)=10\ \log_{10}(P_1/P_2)$$

Unless such losses are minimized, the benefits of using HTS or cryo-cooled materials may be lost.

Minimizing heat load is important because cryogenic coolers used to cool the HTS circuits generally have limited cooling capacity and are relatively inefficient. For example, the best cryocoolers currently available require the supply of approximately forty watts of power to a compressor to remove or lift approximately one watt of heat load. Therefore, it is preferable to limit heat load to 0.1 Watts or less.

Although minimizing heat load is important, it is also difficult. Standard coaxial cables are fabricated by extruding or swaging metal tubing (e.g. copper, gold, aluminum, stainless steel, or silver) over a dielectric (e.g., low-loss plastic materials, polyethylene materials, or Teflon™). The thinnest extruded tubing of which applicant is presently aware is about 0.005 inches (about 0.127 mm) thick.

In addition, as described above, one of the advantages of using HTS materials in circuits for microwave systems is the elimination of resistive losses. However, the advantage of reduced resistive loss can only be fully exploited if reflection or return losses (i.e., losses due to mismatches in characteristic impedances of the components) are minimized. This is especially true for components to be used at high frequencies (e.g., mm wave).

A primary candidate for mismatch problems in circuits including HTS materials is the transition through which a coaxial cable is connected to the circuit. In general, HTS material and circuits containing same have optimal properties in a planar configuration. However, coaxial cable is cylindrically shielded. The transition between the planar circuit and the cylindrical cable may contribute significant reflection or return losses.

The circuit bonding process may also affect the geometry of the transition between the circuit and cable. Typical cables require a transition through which the cable may be attached or bonded to a circuit. Typical coaxial cable transitions use the inner conductor of the cable suspended in air (e.g., forming a pin) where the air acts as a dielectric. The suspended conductor may be inadvertently slightly bent during a typical bonding process. The geometry of the transition may suffer from unsatisfactory reproducibility problems because of the mechanical stability (or instability) of the pin. A further disadvantage occurs when the contact is wrapped around the inner conductor pin, unnecessarily increasing inductance.

In addition, the geometry of the transition between the circuit and cable will directly affect the ease of assembly of the device using such components. To maximize ease of assembly the packaging of HTS circuits that are cooled to cryogenic temperatures must include special input and output leads. As explained above, HTS circuits must be cooled to below $T_c$. Generally, such cooling is achieved by holding the circuits in contact with the cold head of a cryocooler (e.g. enclosed in a vacuum dewar). To connect cooled circuits contained in a dewar interconnection points must be provided through a wall in the dewar. Such interconnections provide large thermal conduction paths for already inefficient cryocoolers.

The prior art has failed to provide a signal interface (including a transmission cable and cable-to-circuit transition) between cryogenic components and ambient-environment components for use in radio frequency applications of cold electronics and high temperature superconductors. The prior art has also failed to provide an interface and transmission cable which exhibit low thermal conduction and low electrical losses (e.g. impedance continuity and low reflection losses), and which work over a frequency range including UHF, microwave, and low millimeter-wave frequencies (e.g. up to 40 GHz). The prior art has further failed to provide such an interface which is also mechanically stable (and, therefore, reproducible) and relatively easy to use.

SUMMARY OF THE INVENTION

The present invention comprises a signal interface (including a transmission cable and a cable-to-circuit transition) for connecting cryogenic components and ambient-environment components that are to be used in radio frequency applications of cold electronics and high temperature superconductors. In the preferred embodiment, the transmission cable of the present invention comprises an inner conductor positioned within a dielectric which has a thin outer conductor plated on its outer surface. The preferred embodiment of the cable-to-circuit transition of the present invention is also generally cylindrical and comprises an inner conductor positioned within a dielectric which has a thin outer conductor plated on its outer surface. In addition, the transition also preferably includes a semi-circular end area that provides a flat surface at least for ease of bonding the transition to a cryo-cooled circuit and for impedance matching purposes. Preferably, the components are sized so as to balance heat load through the transmission cable and transition with the insertion loss.

As is mentioned above, outer conductors for coaxial cables are generally fabricated by extruding or swaging metal tubing over a dielectric. As is also mentioned above, the thinnest extruded tubing of which applicant is presently aware is about 0.005 inches (about 0.127 mm) thick. Such extruded tubing experiences higher heat conduction than would a thinner metal tubing. For example, tubing having a thickness of 0.005 inches (about 0.127 mm) experiences a heat load which is eight times the thermal conduction of a similar tubing having a thickness of about 0.0008 inches (about 20$\mu$) and twenty times the thermal conduction of a similar tubing having a thickness of about 0.00024 inches (about 6$\mu$).

In the most preferred embodiment, the transmission cable of the present invention comprises a coaxial cryocable having a center conductor surrounded by a dielectric (e.g., Teflon™) surrounded by an outer conductor which has a thickness between about 6 and 20 microns. The heat load is preferably less than one Watt, and most preferably less than one tenth of a Watt, with an insertion loss less than one decibel. The preferred overall geometry of the preferred embodiment of the cable is generally cylindrical, although other geometries are possible (e.g. stripline, microstrip, coplanar or slotline geometries).

The present signal interface (i.e., cable and transition) exhibits low thermal conduction, low electrical losses (e.g., impedance continuity and low reflection losses), and works over a frequency range including UHF (300–3000 MHz), microwave, and low millimeter-wave frequencies (e.g., up to 40 GHz). The present signal interface also is mechanically stable, reproducible, and relatively easy to use.

In another aspect of the present invention, a push-on connector may be provided at one or both ends of the cryocable. Such push-on connectors have not previously been used in high vacuum cryogenic applications. Mating connectors may also be provided to connect the cryocable to a hermetic feedthrough and/or to the HTS circuit. The push-on connector design allows fast, simple, and repeated connection and disconnection of the cryocable from the feedthrough and/or the HTS circuit.

It is a principal object of the present invention to provide an improved signal interface.

It is also an object of the present invention to provide a signal interface that exhibits desirable electrical properties (e.g., low electrical reflection, and power losses, and impedance continuity).

It is an additional object of the present invention to provide a signal interface that is mechanically stable and readily reproducible.

It is a further object of the present invention to provide a signal interface that is easy to assemble.

It is another object of the present invention to provide a signal interface for connecting cryogenic components and ambient-environment components that are to be used in radio frequency applications of cold electronics and high temperature superconductors.

It is also the object of the present invention to select appropriate materials, thereby providing very low outgassing materials which allows the vacuum integrity to be preserved for several years.

It is also an object of the present invention to provide a hermetic feed-through from the vacuum side of a dewar to the warm side of the dewar, which also allows for the vacuum integrity to be preserved for several years.

It is yet another object of the present invention to provide a push-on connector that allows easy connection and disconnection of a cryocable from an hermetic feedthrough and/or an HTS circuit.

It is also an object of the present invention to provide a clean cryocable with no entrapped contaminants that will compromise the vacuum integrity.

It is also an object of the present invention to provide a signal interface that exhibits low thermal conduction.

It is yet another object of the present invention to provide a signal interface that exhibits low electrical losses, impedance continuity and low reflection losses.

It is still another object of the present invention to provide a signal interface that works over a frequency range including UHF, microwave, and low millimeter-wave frequencies (e.g. up to 40 GHz).

It is a further object of the present invention to provide a signal interface that includes a coaxial cryocable having a central conductor surrounded by a dielectric having an outer conductor plated on its surface.

It is also a further object of the present invention to provide a signal interface which includes a cable-to-circuit transition having a coaxial connecting end to which a coaxial cable may be attached and a flat bonding surface end to which a circuit may be bonded.

Other objects and features of the present invention will become apparent from consideration of the following description taken in conjunction with the accompanying drawings.

DETAILED DESCRIPTION OF THE PREFERRED EMBODIMENTS

Figure 5:
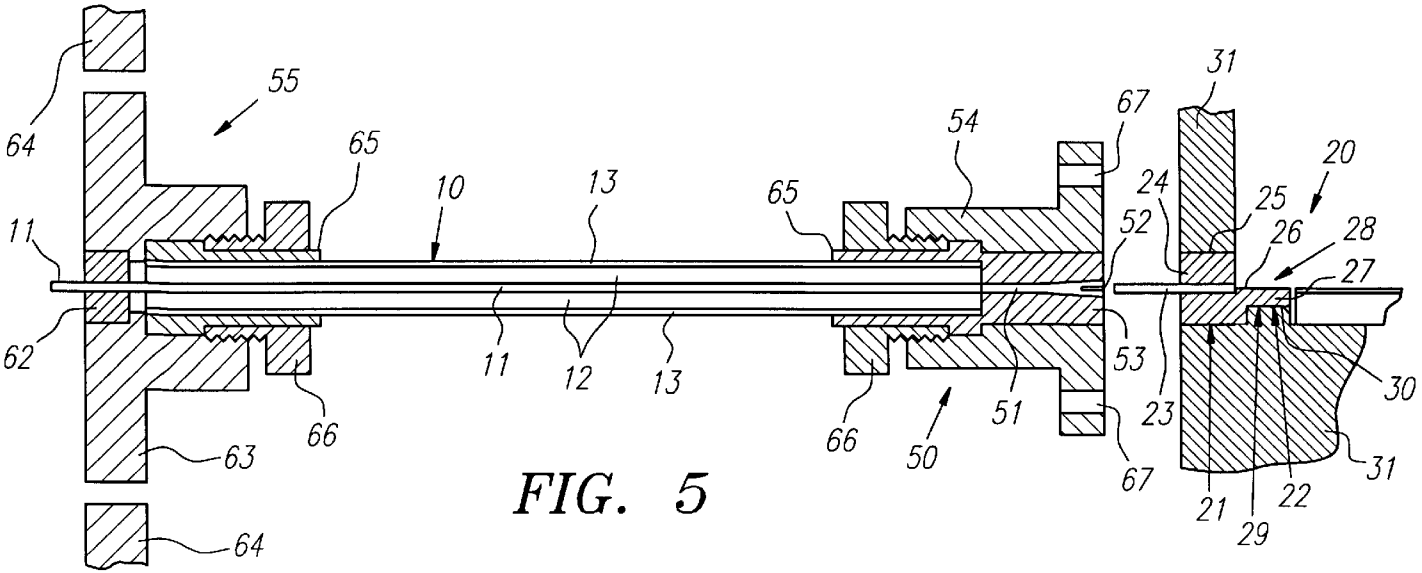
FIG. 5 is a cross-sectional view of an embodiment of the coaxial cryocable of the present invention having a similar connector to those shown in FIG. 4 on one end and of an embodiment of the trough line of the present invention that mates to this connector. On the other end of the cable is a fired-in glass feedthrough through which a continuous center conductor passes that continues all the way to the connector that mates with the trough line interface.

As shown in FIG. 5, the preferred signal interface of the present invention comprises a cryocable 10 and a cryocable transition 20. Like reference labels appearing in the figures refer to the same elements from figure to figure and may not be explicitly described for all of the figures. The transition 20 is preferably both co-planar and coaxial. The transition 20 may be used to transition circuitry to the cryocable 10 of the present invention or other coaxial cables as are known in the art.

Figure 1:
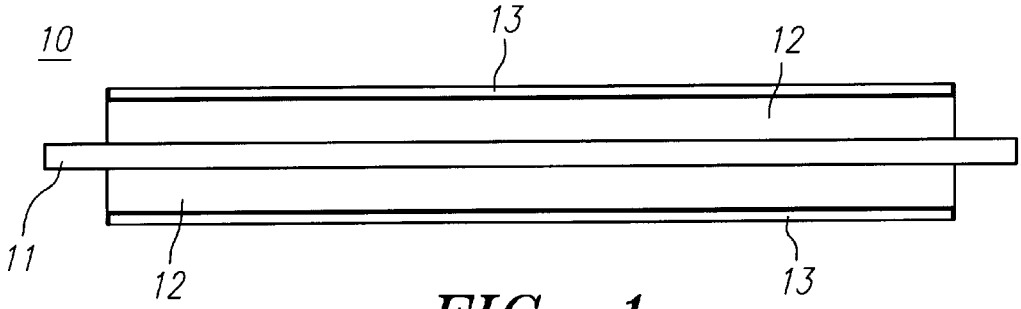
FIG. 1 is a cross-sectional view of a preferred embodiment of the cryocable of the present invention.

The present invention provides a coaxial cryocable 10 which may be used to connect devices held at widely differing temperatures (e.g., up to temperature differences of about 50 to 400 K (° C.) (i.e., temperature differences of about 90 to 720° F.)) while minimizing signal losses and thermal conduction. As shown in FIG. 1, the present invention provides a coaxial cryocable 10 comprising an inner conductor 11. The inner conductor 11 is a wire, preferably solid, of very low thermal conductivity which is preferably copper, gold, or silver plated by electroplating to a thickness which can easily be controlled and/or varied to match the operating frequency of the system.

The cryocable 10 also comprises a dielectric 12 that is preferably made of Teflon™ or other dielectrics that are well known in the art. The dielectric constant of Teflon™ is substantially constant from about 800 MHz through 40 GHz. The dielectric 12 is preferably an extruded tubing such as is available from Zeus Industrial Products, Inc., 501 Boulevard St., Orangeburg, S.C. 29115, U.S.A. The inner conductor 11 should fit inside the dielectric tube 12.

The cryocable 10 further comprises an outer conductor 13. The outer conductor 13 is preferably a copper, gold, or silver layer which is preferably formed by electroplating the outer surface of the dielectric tube 12 with the desired metal. The thickness of the outer conductor 13 may be accurately controlled by the electroplating process. Electroplating the dielectric may be accomplished by plating firms such as Polyflon Company, 35 River St., New Rochelle, N.Y. 10801, U.S.A..

In determining optimal dimensions of the inner conductor 11, the dielectric 12, and the outer conductor 13 the following must be considered: (1) the heat load provided by various thicknesses of outer conductor 13 and various diameters of inner conductor 11 (FIG. 2); and (2) the attenuation experienced by various diameters of inner conductor 11 at various operating frequencies (FIG. 3).

Figure 2:
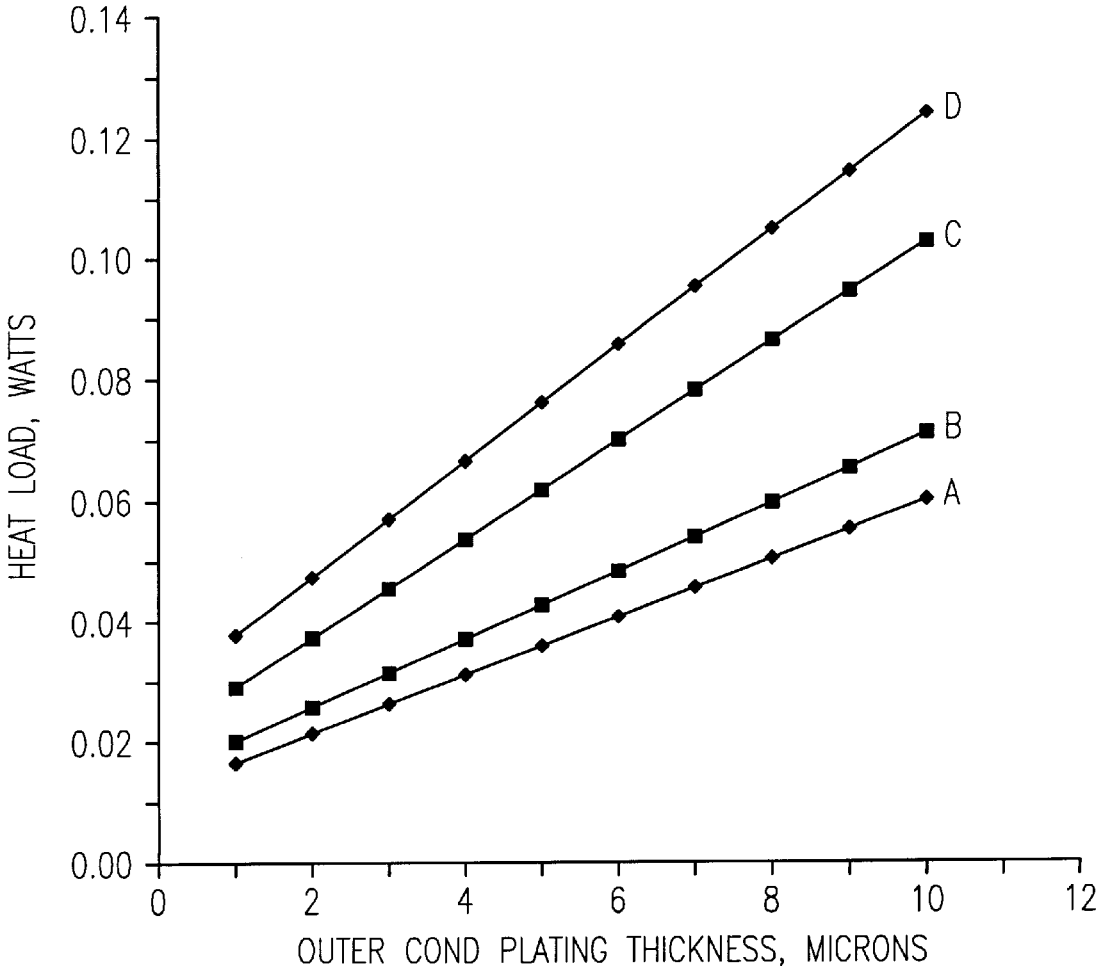
FIG. 2 is a plot of heat load in Watts versus outer conductor upper plating thickness in microns for coaxial cables with various outer diameters.
Figure 3:
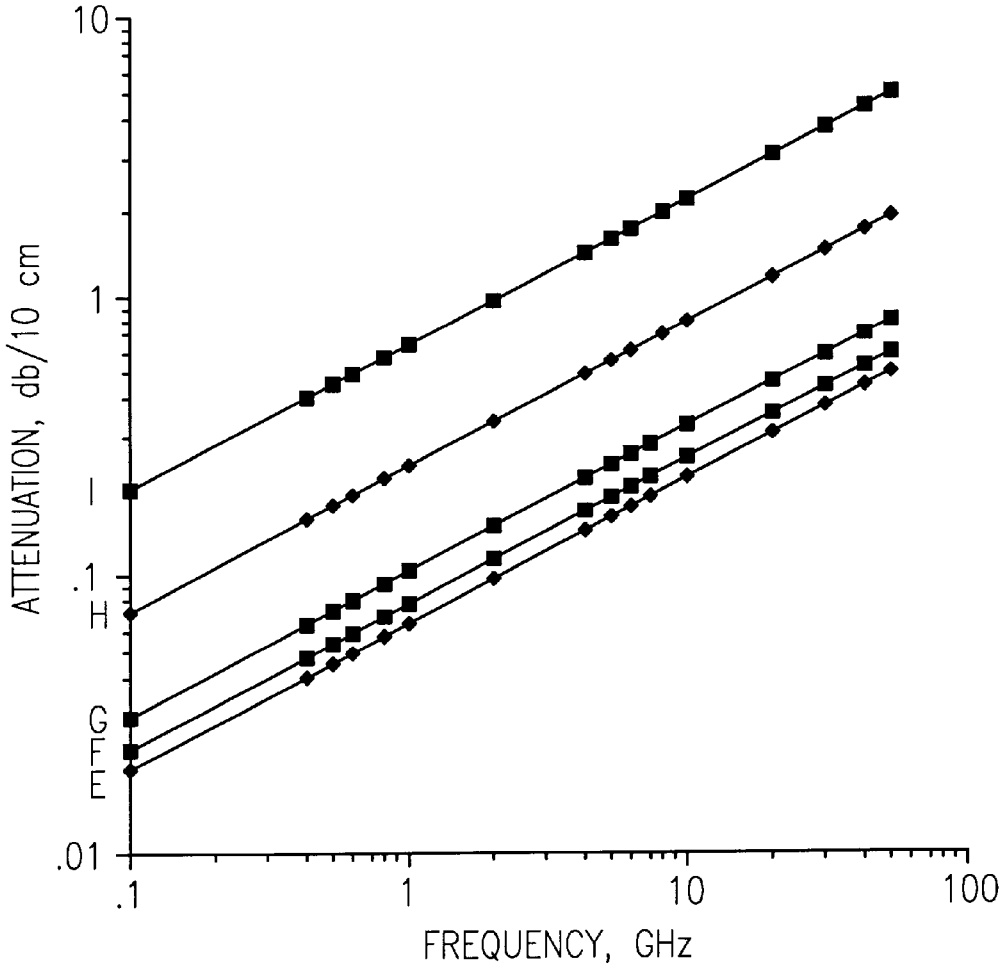
FIG. 3 is a plot of attenuation in decibels per 10 centimeter length versus frequency in gigahertz for coaxial cables with various outer diameters.

FIG. 2 shows the heat load provided by outer conductors having various diameters when the inner conductor has various diameters and when the cryocable is 5 cm long. Table 1 shows the dimensions and materials used for the cryocables from which the information for FIG. 2 was generated.

TABLE 1

| | INNER CONDUCTOR | | OUTER CONDUCTOR | |
|---|---|---|---|---|
| LINE | DIAMETER | MATERIAL | DIAMETER | MATERIAL |
| A | 0.010" | COPPER* | 0.0335" | COPPER |
| B | 0.012" | COPPER* | 0.040" | COPPER |
| C | 0.017" | COPPER* | 0.057" | COPPER |
| D | 0.020" | COPPER* | 0.067" | COPPER |

Copper Plated CRES (Corrosion Resistant Steel)

As explained above, it is preferable to keep the heat load below 0.10 Watts. Therefore, an extrapolation of line A of FIG. 2 indicates that a cryocable 10 having an inner conductor 11 about 0.010 inches thick, should have an outer conductor 13 which is preferably no more than about 20 microns thick to keep the heat load to no more than about 0.10 Watts. As indicated by line D of FIG. 2 the maximum thickness for the outer conductor 13 of a cryocable 10 having an inner conductor 11 about 0.020 inches thick for a heat load of 0.1 Watt is preferably no more than about 7.5 microns thick.

FIG. 3 shows the attenuation or insertion loss experienced by various cryocables operating at various operating frequencies. Table 2 shows the dimensions and materials used for the cryocables which were tested for FIG. 3. In all examples the copper plating is about 6 microns thick (i.e., 3 skin depths).

TABLE 2

| | INNER CONDUCTOR | | OUTER CONDUCTOR | |
|---|---|---|---|---|
| LINE | DIAMETER | MATERIAL | DIAMETER | MATERIAL |
| E | 0.020" | COPPER | 0.067" | COPPER |
| F | 0.0.17" | COPPER | 0.057" | COPPER |
| G | 0.012" | COPPER | 0.040" | COPPER |
| H | 0.012" | COPPER | 0.040" | CRES |
| I | 0.0045" | SPCW* | 0.015" | CRES |

** Silver Plated Copper Clad Steel

FIG. 3 shows that as the conductors of the cryocables get smaller and smaller the attenuation gets larger and larger. Therefore, although smaller conductors are preferred to minimize heat load (see FIG. 2), smaller conductors may also lead to unacceptably high insertion losses.

For microwave and radio frequency operations of cold electronics or circuits that include high temperature superconductor material a preferred operating frequency range is up to about 40 GHz. In addition, for such applications it is preferable that the attenuation amount to no more than about 0.7 dB for a 10 cm length of cryocable. Cryocables represented by lines E, F, and G, in FIG. 3, have no more than 0.7 dB attenuation when operating at 40 GHz. As explained above, the smaller cryocables have smaller thermal conduction. Therefore, the preferred cryocable is the smaller cryocable such as that represented by line G.

In addition, the ratio of the outer diameter of the inner conductor 11 (i.e., the inner diameter, ID, of the dielectric 12) and the inner diameter of the outer conductor 13 (i.e., the outer diameter, OD, of the dielectric) is relatively fixed, by formula, depending on the range of operating frequencies of the cryocable 10, the impedance of the cryocable 10, and on the dielectric constant of the dielectric 12. For example, for an impedance of 50 Ω, the ratio of OD to ID is approximately 3.35. The desired ratio is easily calculated by those skilled in the art according to the known formula:

$$Z_0=(138/\sqrt{E_r})\log_{10}(OD/ID)$$

wherein $Z_0$ is the characteristic impedance of the coaxial cable and $E_r$ is the dielectric constant. Furthermore, the sum of the ID and OD relate to the maximum voltage of operation. For example, if the sum of an ID and OD amounts to 0.12 inches, the signal will start deteriorating at about 40 GHz.

Taking into consideration all of the above, the features of the cryocable 10 of the present invention having the following dimensions. The inner conductor 11 preferably has a diameter of about 0.012 inches (i.e., 0.30 mm), and the plating on the inner conductor 11 is preferably no thicker than 20 microns. The dielectric tubing 12 preferably has an inner diameter of about 0.012 inches (i.e., 0.30 mm) and an outer diameter of about 0.040 inches (1.02 mm). To reduce thermal conductivity, the outer conductor 13 is preferably on the order of between about twenty and about six microns thick. This thickness should allow for at least a few skin depths. For example, if the plating is copper, it is preferably at least about 0.00024 inches (i.e., 6$\mu$) which is about three skin depths thick at 1 GHz.

The coaxial cryocable 10 comprising the structure and materials described above is semirigid and can be bent slightly to facilitate connecting the cryocable 10 to components. In addition, a service loop may be provided to allow for thermal contraction of the cryocable 10 when it is cooled from a room ambient temperature of about 300 K (i.e., about 27° C. or 80° F.) to a cryogenic temperature of 77 K (i.e., about −196° C. or −321° F.).

As is explained above, a typical coaxial cable requires a transition and a typical transition comprises an inner conductor suspended in air (e.g. forming a pin) where the air acts as a dielectric for the inner conductor. As is also explained above, wire bonding reproducibility may be affected where the suspended conductor is bent during the process of attaching or wire bonding the cable to a circuit. Mechanical stability of the pin is greatly increased if the dielectric material under the pin were solid, rather than air. Bonding to the pin is easier when the pin has a flat surface to which to bond. The present invention utilizes these structures.

Figure 4:
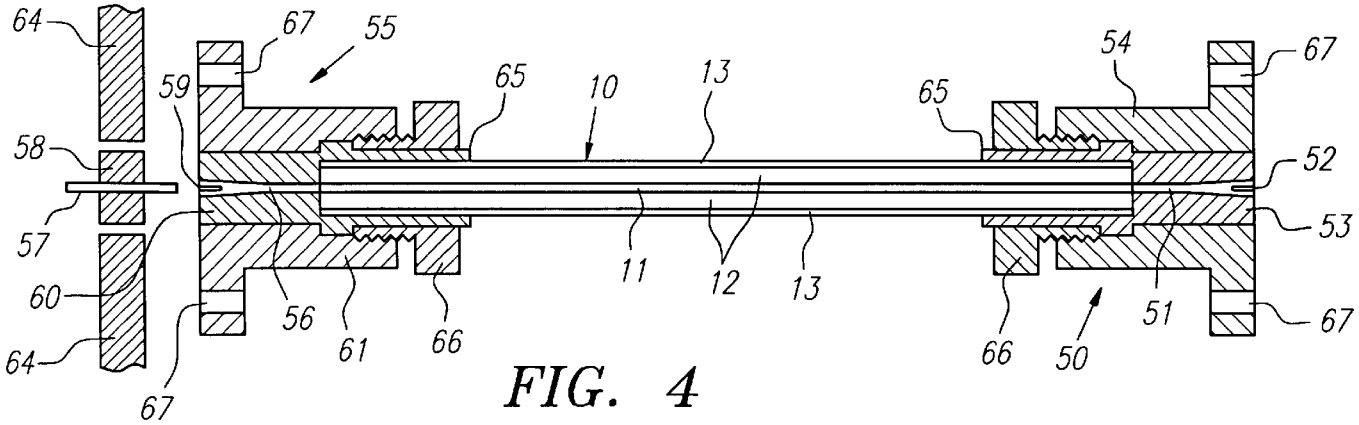
FIG. 4 is a cross-sectional view of an embodiment of the coaxial cryocable of the present invention having connectors on each end and of a preferred embodiment of the glass feed through of the present invention.

As shown in FIGS. 4 and 5, it is preferred that the coaxial cryocable 10 of the present invention be connectable at each end. One end of the cryocable 10 should be connectable to cold electronics or circuits containing high temperature superconductors, preferably through the cable transition 20 of the present invention which is described below and shown in FIG. 5. The other end of the cryocable 10 should be connectable to ambient environment electronics, preferably through a connection which would maintain an hermetic vacuum seal so the cryocable 10 may be positioned within a dewar holding cooled components without providing a vacuum leak as is described below and shown in FIGS. 4 and 5.

Generally, as is explained above, circuits which must be held at cryogenic temperatures (e.g., 77 K, −196° C., −321° F.) are placed in contact with a cold plate in a vacuum dewar or similar holding device. The cryocable 10 of the present invention must be connectable through the dewar to ambient environment while maintaining the vacuum within the dewar.

As shown in FIGS. 5–8, the present invention includes a cable transition 20 that has a cylindrical portion 21 and a semi-cylindrical portion 22. The cylindrical portion 21 includes a cylindrical inner conductor 23, a cylindrical solid dielectric 24, and an outer conductor 25 on the curved outer surface of the cylindrical dielectric 24.

Also shown in FIGS. 5–8, the semi-cylindrical portion 22 includes a semi-cylindrical inner conductor 26 and a semi-cylindrical solid dielectric 27. The semi-cylindrical inner conductor 26 and dielectric 27 form a flat exposed surface 28. The semi-cylindrical portion 22 includes a semi-cylindrical surface 29 and an outer conductor 30 preferably plated on the curved outer semi-cylindrical surface 29 of the semi-cylindrical dielectric 27. The outer conductors 25 and 30 provide metal surfaces that may be soldered to a metal circuit housing 31 as shown in FIG. 5. The dielectric 24 and 27 could be made of any suitable material and is preferably made from a hard plastic such as PEEK available from Victrex® of ICI Advanced Materials, 475 Creamery Way, Exton, Pa. 19341, U.S.A.

Because the outer conductor 30 is located only on the semi-cylindrical surface 29 of the dielectric 27, the outer conductor 30 does not completely shield the semi-cylindrical inner conductor 26 electrically. In addition, the overall dielectric constant of the dielectric surrounding the inner conductor 26 (solid dielectric 27 on one side and air on the other) will no longer be uniform. Therefore, the transition 20 will have an impedance which is a function of a dielectric constant which is somewhere between that of the two dielectrics around the inner conductor 26 (solid dielectric 27 and air).

Figure 6:
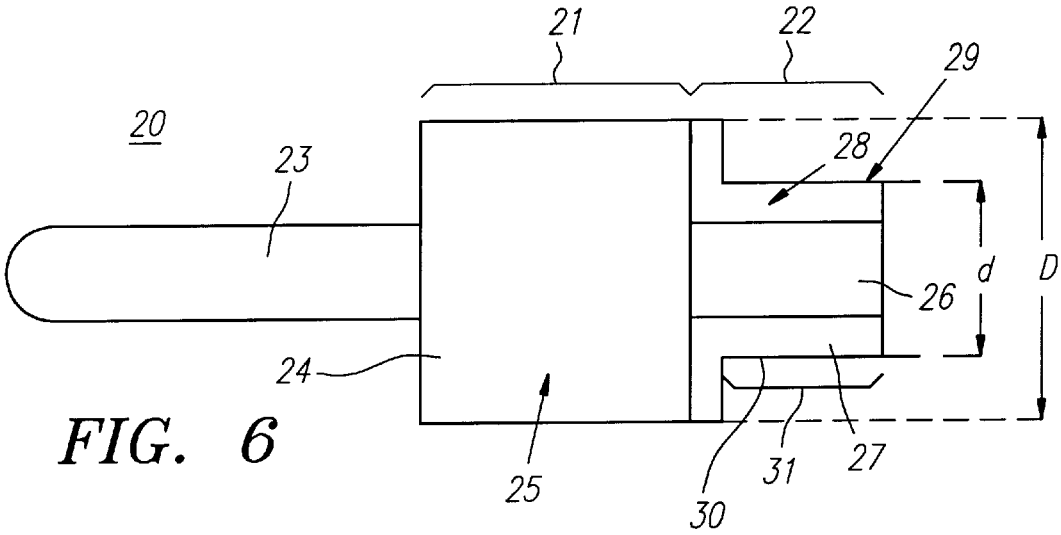
FIG. 6 is a top view of an embodiment of the trough line launch of the present invention.
Figure 7:
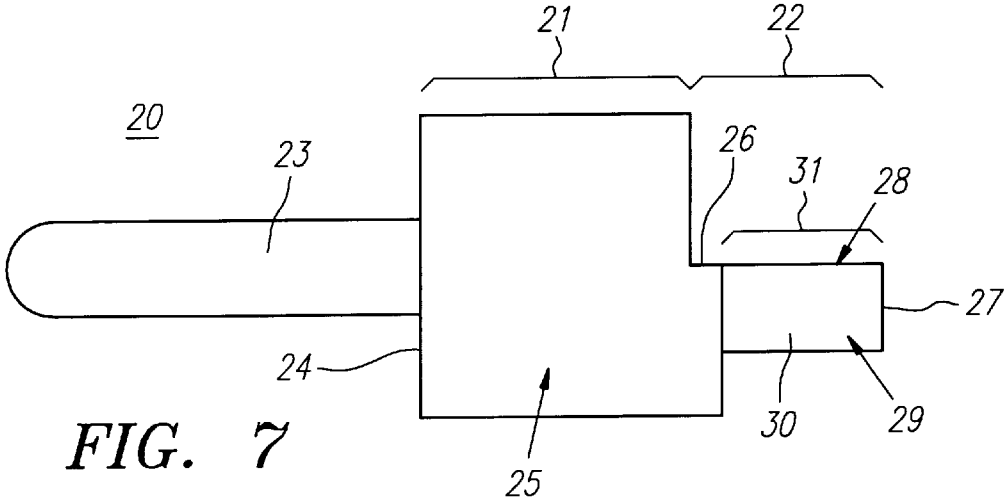
FIG. 7 is a side view of the trough line launch of FIG. 6.
Figure 8:
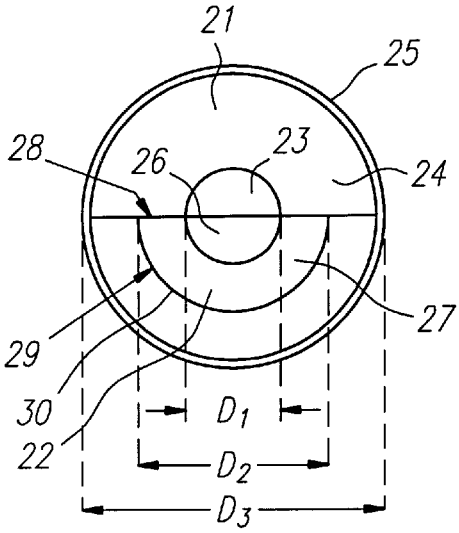
FIG. 8 is a front view of the trough line launch of FIG. 6.

Because air (with a dielectric constant of 1) is the dielectric for about one-half of the semi-cylinder inner conductor 26, the effective dielectric constant of the transition 20 will be lower at the semi-cylindrical portion 22 than it is at the full cylindrical portion 21. Therefore, it is preferable that the diameter d (shown in FIGS. 6 and 8) of the semi-cylindrical portion 22 be smaller than the diameter D (also shown in FIGS. 6 and 8) of the full cylindrical portion 21. The portion of the transition 20 which is semi-cylindrical will be referred to as the cable trough line or CTL 22, as is shown in FIGS. 6 and 7.

A small number of variables have been used to describe the transition 20 of the present invention for the purposes of devising a model. A simple model has been devised to find the impedance of each segment of the transition 20 so that dimensions could be determined for experimentation purposes. $D_1$, $D_2$, and $D_3$ respectively represent the diameters of the semi-cylindrical dielectric 27 at the cable trough line 22, the coaxial inner conductor 23, and the coaxial outer conductor 25. $E_r$ represents the dielectric constant of the solid dielectric 24 in the cylindrical portion 21 and the solid dielectric 27 in the stabilized half of the semi-cylindrical or cable trough line portion 22.

A number of dielectric materials have been considered for use as the solid dielectric 24 and 27. There are many good candidates. The solid dielectric 24 and 27 must bond to the inner conductor 23 and 26, and be suitable for production to small tolerances (possibly 0.001 inches or less (i.e., 0.025 mm or less)). The material is preferably grindable with conventional grinding equipment. Other requirements further narrow the list of possible dielectrics. These requirements include frequency of operation, the nature of the connection cable (and its impedance), vacuum compatibility, temperature exposures, and stability through thermal cycling. Although many materials may be used for the dielectric 24 (e.g. hard plastic such as PEEK), Table 3 below illustrates the output of the model using dense Teflon™ as the dielectric 24.

TABLE 3

| TROUGH/COAX LINE EVALUATION | |
|---|---|
| TROUGH COAX LINE OUTER DIA, $D_1$ | 0.0258" |
| COAX INNER DIA, $D_2$ | 0.0120" |
| COAX OUTER DIA, $D_3$ | 0.0402" |
| 1ST SECTION COAX REL DIEL CONST, $E_r$ | 2.100 |
| 1ST SECTION COAX LINE IMPEDANCE | 50.00Ω |
| IMPEDANCE OF TROUGH LINE | 50.00Ω |
| TOTAL CAP/UNIT L OF TROUGH LINE | 0.8959E − 10 F/m |
| EFFECTIVE DIEL CONST OF TROUGH LINE | 1.806 |
| TROUGH LINE RELATIVE PHASE VELOCITY | 0.7442 |

Some of the benefits of using a material such as PEEK or Teflon™ as the dielectric include that these materials may be produced by injection molding or conventional machining and grinding of a solid piece. In addition, precise dimensions may be obtained. Thus, a transition 20 made with a PEEK or Teflon™ dielectric is easy and inexpensive to produce. The flat surface 28 of the cable trough line 22, shown in FIGS. 5–8, provides a bonding surface which may also be produced inexpensively and in large numbers despite its small size. Therefore, the preferable material for the dielectric 24 and 27 for the transition 20 is a material such as PEEK or Teflon™.

Figure 9:
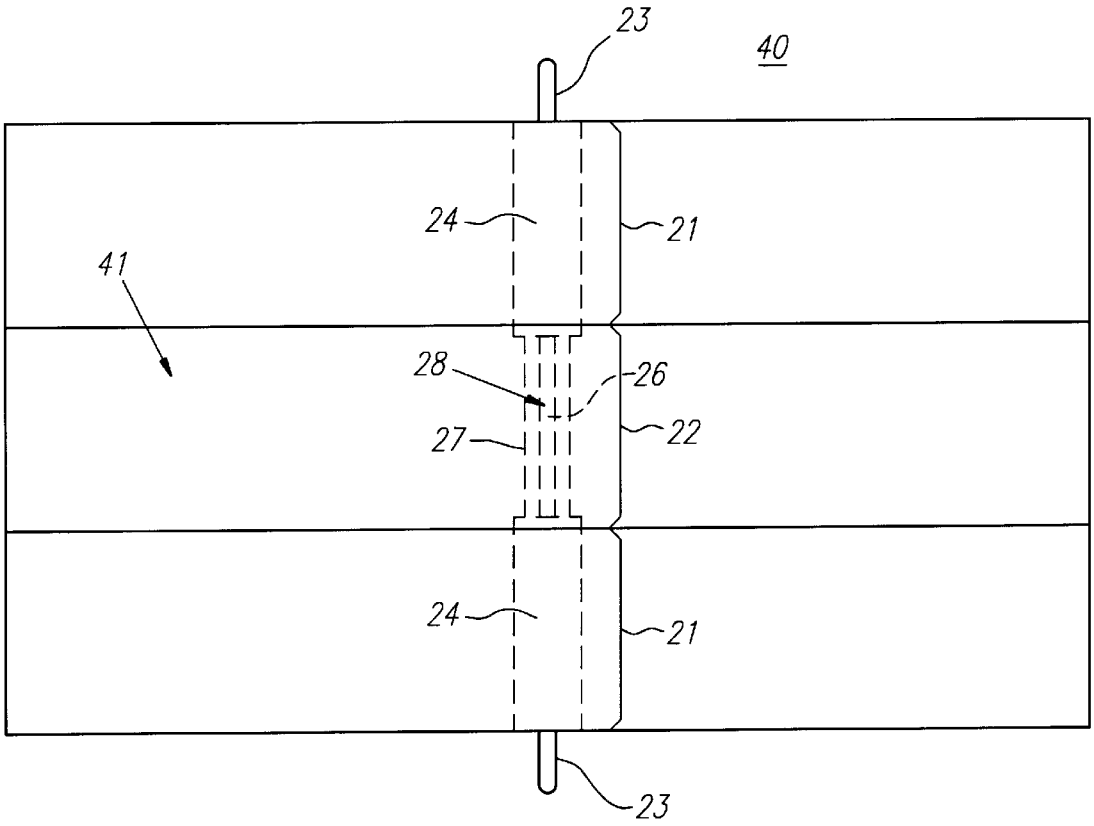
FIG. 9 is a top view of a fixture for determining the sensitivity of a coaxial line's impedance.
Figure 10:
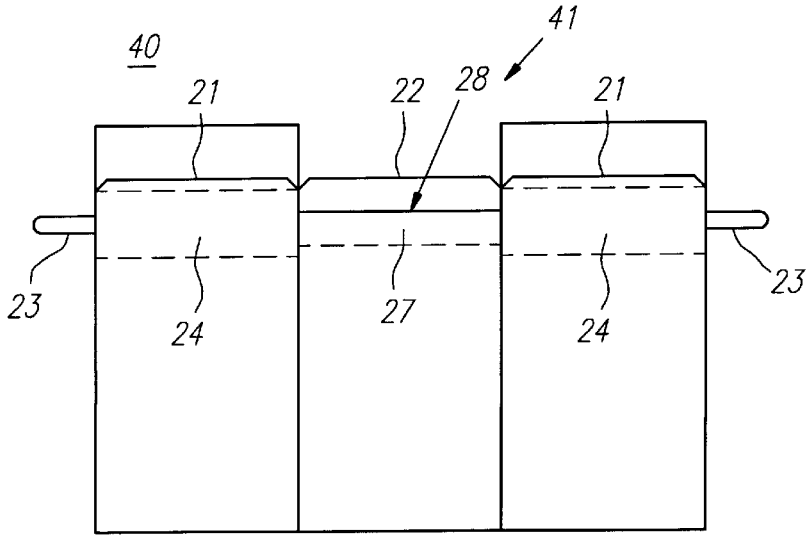
FIG. 10 is a side view of the fixture of FIG. 9.

The degree of precision necessary for the dimensions of the transition 20 must be determined for the particular material used for the dielectric 24 and 27, with consideration of the methods used for constructing the cable trough line 22. FIGS. 9 and 10 show a fixture 40 that may be used to determine the sensitivity of a coaxial line's impedance to the dimensions of the cable trough line 22. K-connector™, which are well known in the art, may be used to interface the fixture 40 with test equipment. The return loss of the fixture 40 is monitored as a fixture-trough 41 (which is to become the cable trough line 22) is ground down. The depth of the fixture trough 41 will be monitored as the grinding progresses so that voltage standing wave ratio (VSWR) at a given frequency can be measured as a function of depth of the trough 41 and used to prove the design dimensions. The dimensions of the fixture 40 may be determined using information such as that in Table 3.

Once dimensional specifications are determined for the dielectric 24 and 27 and inner conductor 23 and 26, a method of manufacturing the transition 20 can be determined. For a solid dielectric material with a strong interface to the inner conductor 23 and 26 (such as sealing glass), a grinding process could be used once the dielectric 24 and 27 is attached to a housing. For a softer dielectric material, such as Teflon™ or PEEK, the dielectric 24 and 27 could be manufactured separate from the inner conductor 23 and 26 and used as a standard part for any variety of housings.

The transition 20 may be manufactured through a process similar to that described above for the cryocable 10. However, before the outer conductors 25 and 30 (shown in FIGS. 5–8) are plated on the cylindrical surfaces of the dielectric 24 and 27, the transition 20 is turned to form the portion with the smaller diameter d (see FIGS. 6, 8). After the portion having the smaller diameter D1 is formed, the outer conductors 25 and 30 may be plated on the exterior surfaces of the dielectric 24 and 27. After the plating is completed, the portion of the transition 20 with the smaller diameter d is then ground down or chopped to form the semi-cylindrical portion 22 and the flat surface 28 of the semi-cylindrical portion 22 (shown in FIGS. 5–8).

Figure 11:
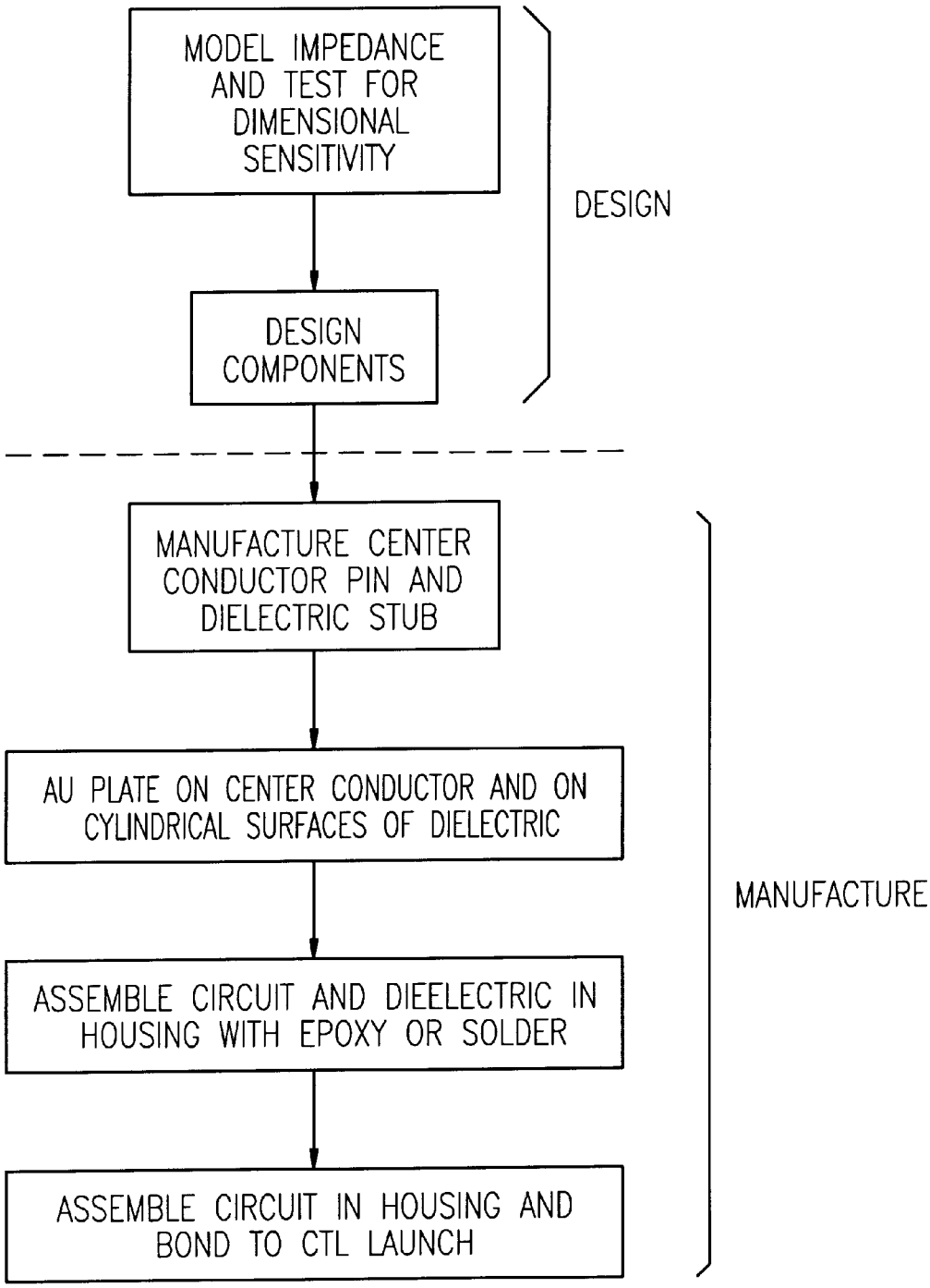
FIG. 11 is a chart showing an exemplary flow for the production and assembly of a trough line of the present invention.

FIG. 11 provides an exemplary flow chart for the production and assembly of a transition 20 including a cable trough line 22 using Teflon™ as the dielectric 24 and 27 material. First, as is described above, a model of the transition 20 should be tested for its impedance at various dimensions. Then, the particular components may be designed. Next, the inner conductor 23 and 26 and the dielectric 24 and 27 are manufactured. Then, the inner conductor 23 and 26 and the outer curved surfaces of the dielectric 24 and 27 are plated. Finally, the inner conductor 23 and 26 is positioned in the dielectric 24 and 27 and glued, bonded, epoxied, soldered, or held by friction in place. The transition 20 is now ready to be assembled in a housing and bonded to a circuit as shown in FIG. 5.

Coaxial connectors enable the cryocable 10 to connect to the transition 20 and/or to electronics held at ambient temperatures. FIGS. 4 and 5 show an exemplary cold housing connector 50 that provides an appropriate coaxial connection between the cryocable 10 and the transition 20. The cold housing connector 50 includes an end receptacle or sleeve 51 which accepts both the inner conductor 11 from the cryocable 10 and the inner conductor 23 from the transition 20 (see FIG. 5). The inner conductors 11 and 23 may be soldered together within the end receptacle 51. The end receptacle 51 may be provided with a spring finger contact 52 to provide a snug fit between the inner conductor 23 and the end receptacle 51.

As shown in FIGS. 4 and 5, axially surrounding the end receptacle 51 is a dielectric 53 and axially surrounding the dielectric 53 is a metal connector housing 54. The dielectric 53 must be sized to provide the cold housing connector 50 with the appropriate impedance (i.e., with an impedance which matches that of the cryocable 10 and the transition 20). One would expect that to provide the cold housing connector 50 with the appropriate impedance the dielectric 53 would be of a larger diameter than the dielectric 12 of the cryocable 10 due to the end receptacle 51 having a larger diameter than the inner conductor 11. The connector housing 54 is preferably made from metal and preferably acts as an outer conductor for the connector 50.

FIGS. 4 and 5 each show an embodiment of an exemplary warm housing connector 55 that may provide an appropriate coaxial connection between the cryocable 10 and electronics held at ambient temperatures. The warm housing connector 55 shown in FIG. 4 includes an end receptacle or sleeve 56 which accepts both the inner conductor 11 of the cryocable 10 and a feed through inner conductor 57. As is mentioned above, it is preferable that the connection between the cryocable 10 and ambient temperature electronics have a vacuum seal so, for example, the connection may extend through the wall of a vacuum dewar. The feed through inner conductor 57 shown in FIG. 4 is provided with a soldered in glass bead 58 surrounding the inner conductor 57 and thereby providing a vacuum seal. The glass bead 58 may then be attached to the wall of the dewar to provide a vacuum tight seal. The glass bead 58 has a metal outer coating to enable the glass bead 58 to be soldered into the dewar wall to thereby provide a vacuum tight seal. The inner conductors 11 and 57 may be soldered together within the end receptacle 56. The end receptacle 56 may be provided with a spring finger contact 59 (see FIG. 4) to provide a snug fit between the inner conductor 57 and the receptacle 56.

The warm housing connector 55 shown in FIG. 4 also includes a dielectric 60 axially surrounding the end receptacle 56 and a metal connector housing 61 axially surrounding the dielectric 60. As with the dielectric 53 of the cold housing connector 50 described above, the dielectric 60 of the warm housing connector 55 must be properly sized to provide the connector 55 with the appropriate inductance. As with the connector housing 54 of the cold housing connector 50 described above, the connector housing 61 of the warm housing connector 55 is preferably made from metal and is preferably gold plated so it acts as an outer conductor for the connector 55.

The warm housing connector 55 shown in FIG. 5 incorporates the inner conductor 11 of the cryocable 10 as a continuous inner conductor. The inner conductor 11 extends through a fired in glass bead 62. The fired in glass bead 62 provides a vacuum seal between the inner conductor 11 and a metal connector housing 63. The metal connector housing 63 may then be directly attached to the dewar housing 64 via, for example, electron beam or laser welded.

As shown in FIGS. 4 and 5, the cryocable 10 is preferably connected to the cold housing connector 50 and the warm housing connectors 55 via separate protective jacket 65 and a threaded collar 66 arrangements. The protective jackets 65 are preferably provided over a portion of the outer conductor 13 of the cryocable 10 that is to be covered by the threaded collars 66. The protective jackets 65 protect the thin outer conductor 13 from being damaged by the connection. The threaded collars 66 preferably fit over the protective jackets 65 and by pressure contact caused by the collar 66 threadedly screwing into the housing 54, connect the cryocable 10 to the cold housing connector 50 and the warm housing connector 55. The threaded collars 66 provide mechanical rigidity and electrical integrity to the cryocable 10 at the connections.

The cold housing connector 50 and the warm housing connectors 55 may be provided with bolt apertures 67 (shown in FIGS. 4 and 5) to enable the cold housing connector 50 to be bolted to the circuit housing 31 and the dewar housing 64 respectively. However, as is explained above, the warm housing connector 55 shown in FIG. 5 may be directly connected to the dewar housing 64 by means other than bolting (i.e., by soldering, gluing, electron beam welding or laser welding).

Figure 12:
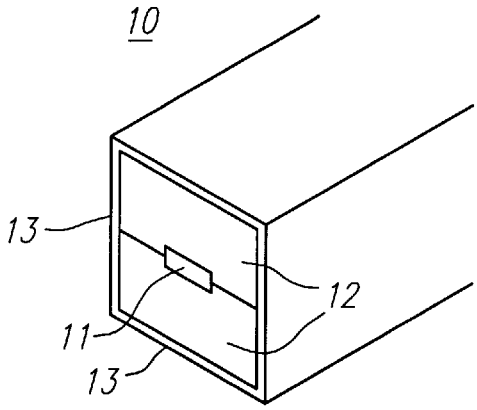
FIG. 12 is a perspective view of a stripline cryocable of the present invention.
Figure 13:
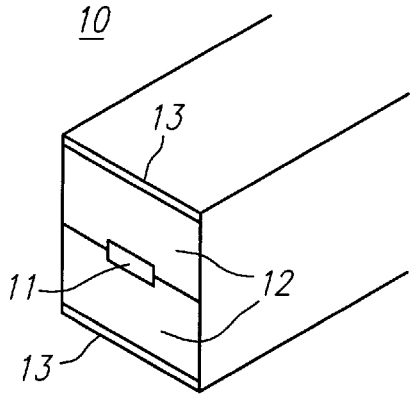
FIG. 13 is a perspective view of a second embodiment of a stripline cryocable of the present invention.

Embodiments of interconnects other than a coaxial cable geometry may be used to accomplish the present invention. Specifically, the cryocable 10 may be produced as a stripline (with or without side grounds) as shown in FIGS. 12 and 13 respectively. Such stripline cryocables 10, as are shown in FIGS. 12 and 13, would include a center conductor 11, a surrounding dielectric 12, and an outer conductor 13 which may completely surround the dielectric 12 as is shown in FIG. 12 or which may exist only on two sides of the dielectric 12 as is shown in FIG. 13.

Figure 18:
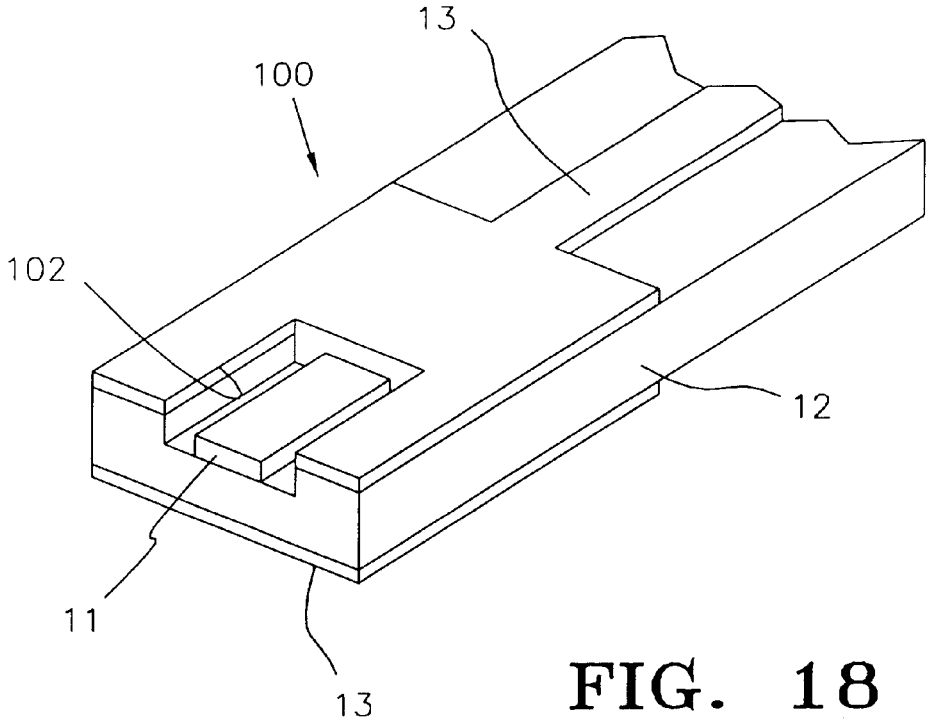
FIG. 18 is a perspective view of a first end of a flat cryocable in accordance with the present invention.

In another variation of the stripline configuration, the cryocable may be configured as a flat cryocable 100 as shown in FIG. 18. The flat cryocable 100 is very similar to the cryocable 10 shown in FIG. 13 and likewise includes a center conductor 11 surrounded by a surrounding dielectric 12. The dielectric 12 may be formed by two strips of dielectric, such as PTFE sandwiching the center conductor 11. Outer conductors 13 are attached to two sides of the dielectric 12.

One or both ends of the flat cryocable 100 may be configured as shown in FIG. 18 for attachment to a warm housing connector and/or a cold housing connector. A slot 102 is cut out of the conductor 13 and through the dielectric to expose the center conductor 11 from the top and/or bottom of the cryocable 100 (only a top slot 102 is shown in FIG. 18, with the understanding that a similar slot may be formed in the bottom of the cryocable 100). The method of attachment to a housing connector is described below in detail in conjunction with the description of a push-on connector.

Figure 19:
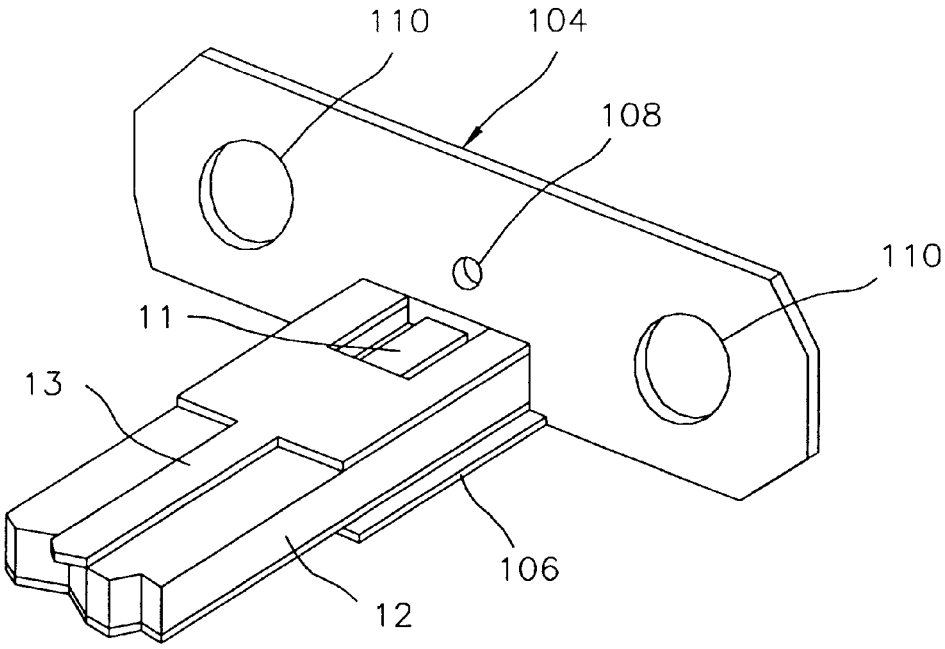
FIG. 19 is a perspective view of a second end of the flat cryocable of FIG. 18.
Figure 20:
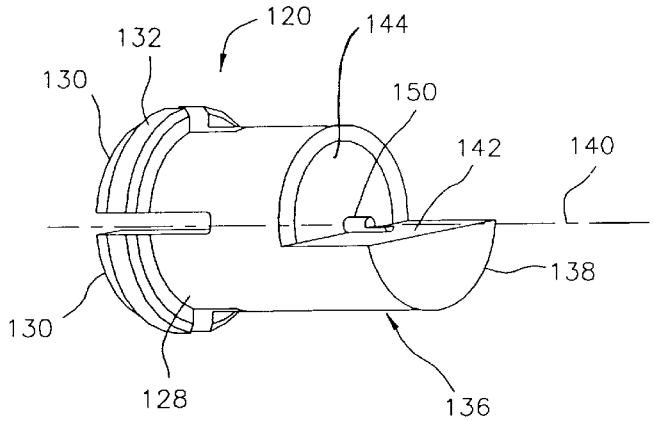
FIG. 20 is a perspective view of a push-on connector in accordance with a preferred embodiment of the present invention.

The opposite end of the flat cryocable 100 may also be configured as shown in FIG. 18, and may additionally be fitted with a T-shaped connector 104 as shown in FIG. 19. The T-shaped connector 104 has a bottom-plate 106 which is bonded to the conductor 13. The T-shaped connector 104 has an access hole 108 to provide access for a connecting HTS circuit to the center conductor 11. Two mounting holes 110 are provided for bolting the T-shaped connector 104 to a structure such as the circuit housing 31 (see FIG. 5).

Figure 14:
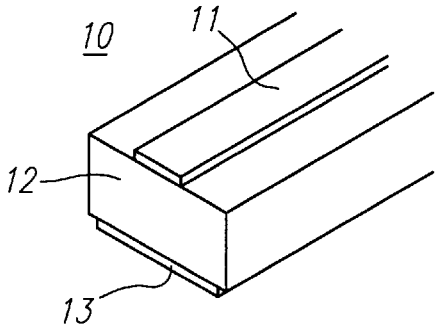
FIG. 14 is a perspective view of a microstrip cryocable of the present invention.
Figure 15:
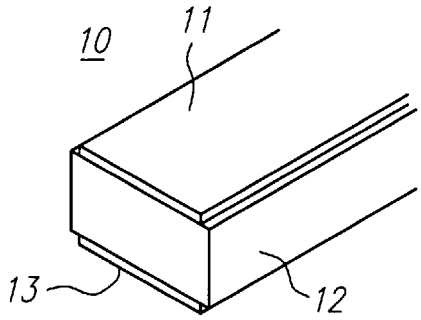
FIG. 15 is a perspective view of a balanced microstrip cryocable of the present invention.

In addition, the cryocable 10 may be produced in a microstrip configuration or a balanced microstrip configuration as is shown in FIGS. 14 and 15 respectively. Such microstrip cryocables 10, as are shown in FIGS. 14 and 15, would include a first conductor 11 which acts as a center conductor, a dielectric 12, and a second conductor 13 which acts as an outer conductor. The first conductor 11 of the microstrip cryocable 10 shown in FIG. 14 is smaller in size than that second conductor 13. As shown in FIG. 15, the first and second conductors 11 and 13 of the balanced microstrip cryocable 10 are of approximately the same size.

Figure 16:
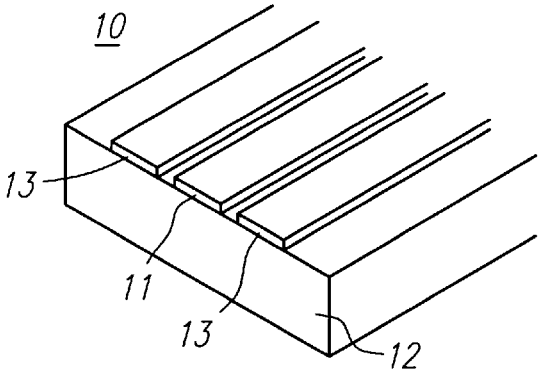
FIG. 16 is a perspective view of a coplanar slot line cryocable of the present invention.
Figure 17:
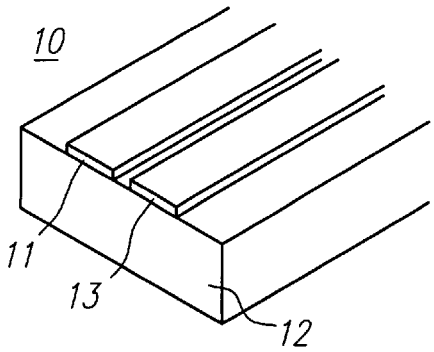
FIG. 17 is a perspective view of a coplanar slot line cryocable of the present invention.

Furthermore, the cryocable 10 may be produced in a coplanar waveguide or a coplanar slotline configuration as are shown in FIGS. 16 and 17 respectively. Such coplanar cryocables 10, as are shown in FIGS. 16 and 17, would include a first conductor 11 which acts as a center conductor, a dielectric 12, and a second conductor 13 which acts as an outer conductor. These cryocables 10 are coplanar because both conductors 11 and 13 are positioned on the same side of a planar dielectric 12, as is shown in FIGS. 16 and 17. The coplanar waveguide cryocable 10, as shown in FIG. 16, includes two-second conductors 13 that are positioned on the dielectric 12 on either side of the first conductor 11. As shown in FIG. 17, the first and second conductors 11 and 13 of the coplanar slotline cryocable 10 are singular and lie next to each other on the dielectric 12.

The use of stripline, microstrip, or coplanar or slotline transmission lines instead of coaxial cables does not change the mode of operation of the cryogenic cables. The basic change is that the stripline interconnects, the microstrip interconnects, and the coplanar or slotline interconnects are rectangular (rather than round as for the coaxial case described above). This means that the stripline, the microstrip, or the coplanar or slotline realization can be manufactured from standard circuit patterning and etching of thin copper conductors on a dielectric substrate (for example, RT Duroid from Rogers Corporation, 100 S. Roosevelt Ave., Chandler, Ariz. 85226, U.S.A.).

In another embodiment of the cryocable 10 shown in FIGS. 4 and 5, the warm housing connector and/or the cold housing connector may be replaced by push-on connectors 120 as shown in FIGS. 20, 21, 21A, 22. Instead of the threaded connectors 50 and 55 a push-on connector 120 may be provided at one or both ends of the cryocable 10. The push-on connector 120 of the present invention allows faster and simpler assembly and disassembly of the cryocable 10 to the HTS circuit and/or the feedthrough than the threaded connectors 50 and 55 described above or bonded connections such as soldering or adhesive.

Figure 22:
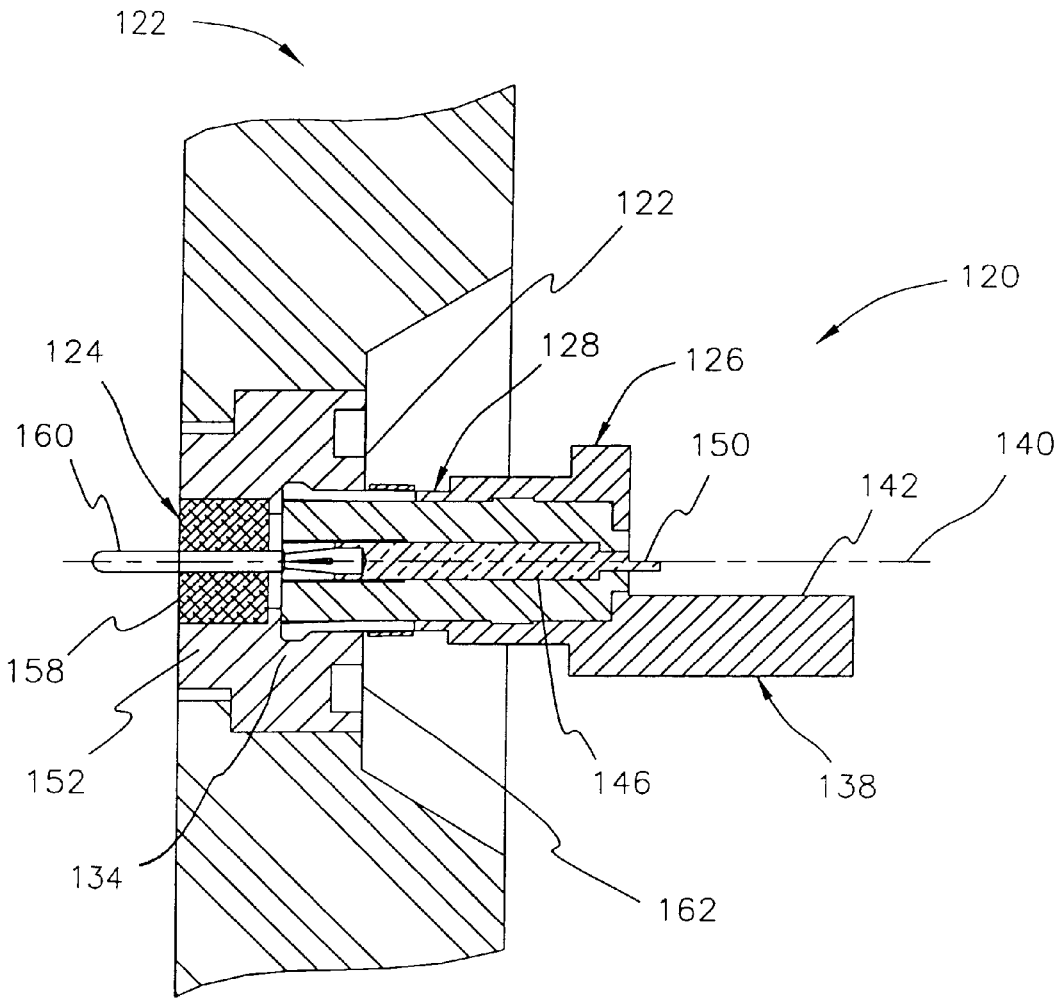
FIG. 22 is a cross-sectional view of the push-on connector of FIG. 21 connected to a mating receptacle and feedthrough in accordance with a preferred embodiment of the present invention.
Figure 23:
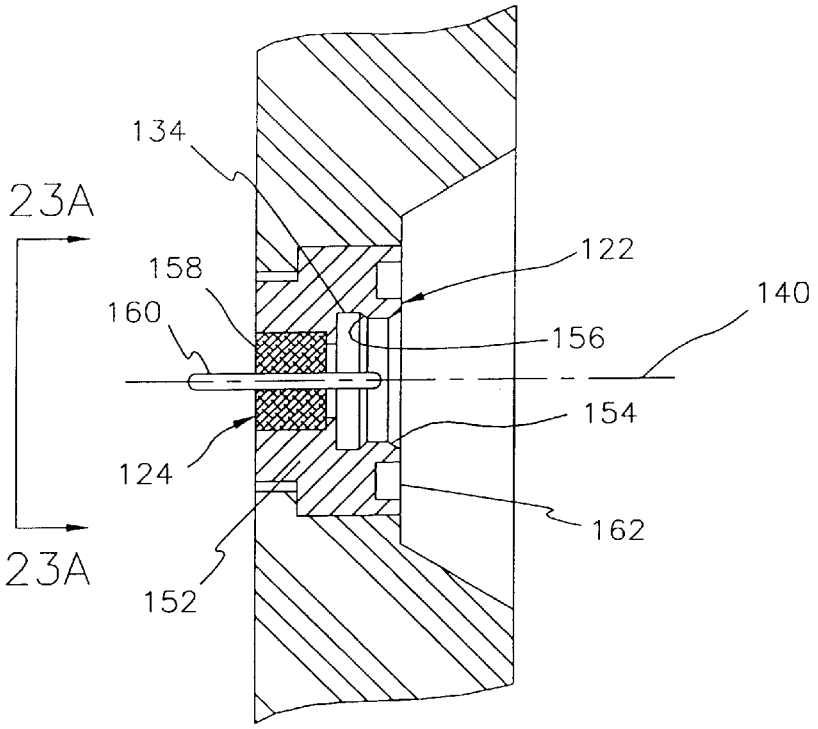
FIG. 23 is a cross-sectional view of a feedthrough in accordance with a preferred embodiment of the present invention.
Figure 23A:
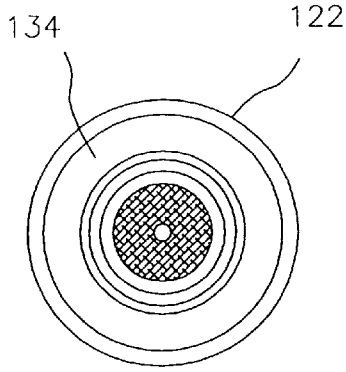
FIG. 23A is an end view of the feedthrough of FIG. 23.
Figure 22:
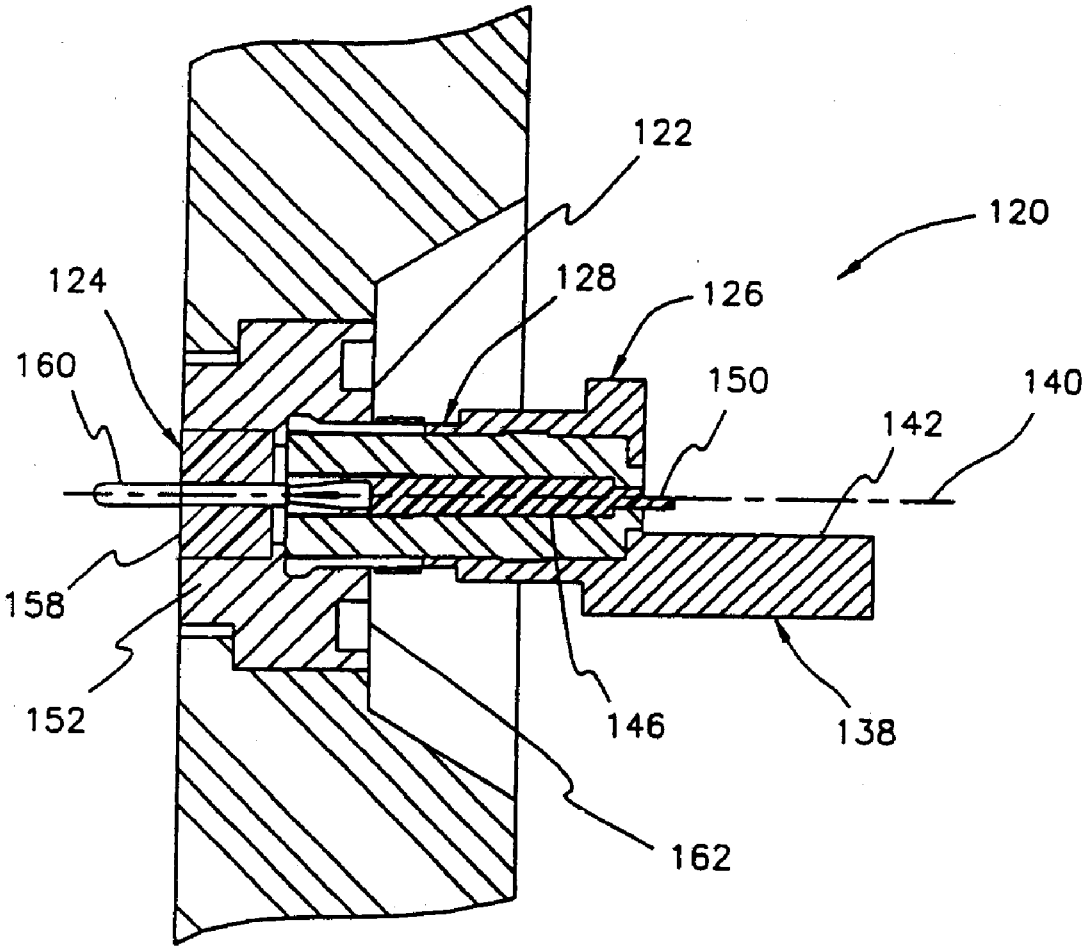

The push-on connector 120 disconnectably mates with a receptacle 122 as shown in FIGS. 22, 23, 23A. At the warm housing side of the cryocable 10, the receptacle 122 may be housed in an ultrahigh vacuum hermetic feedthrough 124. On the cold housing side of the cryocable 10, the receptacle 122 may be integrated with the transition 20, or alternatively, the receptacle 122 may be configured with another connection (not shown) which mates with the transition 20. In the still another embodiment (not shown), an interface connector may be provided which connects the receptacle 122 to the transition 20.

Figure 21:
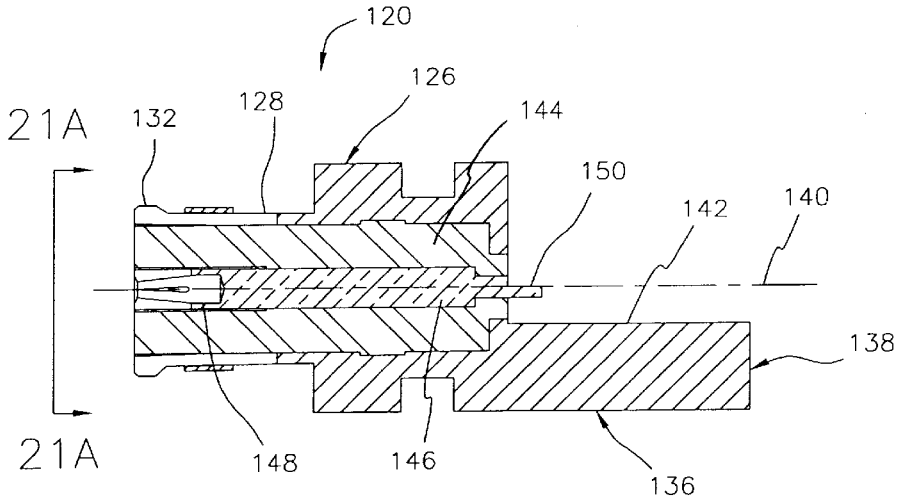
FIG. 21 is a cross-sectional view of a push-on connector in accordance with a preferred embodiment of the present invention.
Figure 21A:
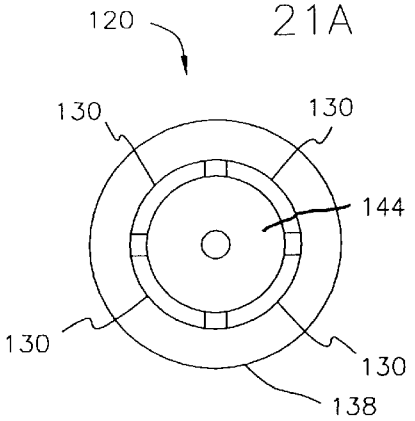
FIG. 21A is an end view of the push-on connector of FIG. 21.

Returning to FIGS. 20, 21, 21A, the preferred embodiment of the push-on connector 120 will be described in detail. The push-on connector 120 comprises an outer shell 126, which is made of an electrically conductive material, preferably BeCu as shown in FIG. 21. The outer shell 126 has a spring-loaded locking portion 128. The locking portion 128 preferably comprises a flared cylinder having longitudinal slots thereby forming a plurality of flexible detents 130. For example, four slots will form four detents 130 (see FIG. 21) as shown in the end view of FIG. 21A. The number of slots may be varied to adjust the flexibility or stiffness desired. A raised lip 132 is provided at the end of the locking portion 128 and is shaped to fit within a recess 134 (see FIG. 22, 23) of the receptacle The end of the outer shell 126 opposite the locking portion 128 is a cable connection 136. The cable connection 136 on the push-on connector embodiment shown in FIGS. 20, 21, 21A, 22 is configured for attachment to the flat cryocable 100 as shown in FIGS. 18–19. It is to be understood, however, that the cable connection 136 may be configured for a coaxial cryocable as shown in FIGS. 4–5, or any other suitable cable, for example, the cables shown in FIGS. 12–15.

The cable connection 136, as shown for the flat cryocable 100, comprises a solid section of a cylinder 138, the section cut just below the center axis 140 of the cylinder to create a flat ledge 142. The flat ledge 142 effectively receives the flat cryocable 100.

A dielectric 144 is inserted into the locking portion 128 and extends to the edge of the ledge 142. The dielectric 144 can be made of any suitable material and is preferably made from PTFE. The dielectric 144 has a center bore which accommodates a center conductor 146 and a spring contact 148 as shown in FIG. 21. The center conductor 146 and the spring contact 148 are electrically conductive and are electrically connected to each other. A portion of the center conductor 146 extends out of the dielectric 82 to form a pin 150 which is easily accessible so it can be connected to the center conductor 11 of the flat cryocable 100.

Referring to FIGS. 22, 23, 23A, the push-on connector 120 is connected mechanically and electrically to the flat cryocable 100 by sliding the slotted end of the cryocable 100 onto the ledge 142. The pin 150 of the push-on connector 120 fits into the slot 102 of the cryocable 100 such that the pin 150 sits on or over the cryocable center conductor 11 that is exposed through the slot 102.

The cryocable center conductor 11 may be attached to the pin 90 via a ribbon wire by ultrasonic bonding, gap welding or any other suitable method. Alternatively, it may be attached directly with solder or conductive adhesive. The conductor 13 of the cryocable 13 is attached to ledge 142 by solder or conductive adhesive.

Returning to FIG. 22, the push-on connector 120 is shown connected to a mating receptacle 122 which is shown integrated with a vacuum feedthrough 124. Although the receptacle 122 is shown in the figures and described herein as integrated within a vacuum feedthrough 124, it is contemplated that the receptacle 122 may be a stand alone connector without the vacuum feedthrough 124. For example, a similar receptacle may be used to connect the cold side of the cryocable 10 to the HTS circuit wherein there is no need for a hermetically sealed feedthrough.

As is shown in FIGS. 23 and 23A, the receptacle 122 has a body 152, preferably formed of Kovar. The body 152 has a substantially cylindrical cavity sized to receive the locking portion 128 of the push-on connector 120. The receptacle 122 further includes a lead-in chamfer 154 and the recess 134 shaped to receive the raised lip 132 of the locking portion 128. Another chamfer 156 is provided to facilitate removal of the locking portion 128 from the receptacle 122. The chamfers 154 and 156 bias the detents 130 upon insertion and removal of the push-on connector 120 from the receptacle 122.

The feedthrough 124 further comprises a dielectric 158 bonded to the body 152 in a manner which provides a high vacuum tight seal between the dielectric 158 and the body 152. The dielectric is preferably made of glass, for example Corning 7052. Suitable glass-to-metal (e.g., Kovar to Corning 7052) sealing techniques are described in E. B. Shand, *Glass Engineering Handbook,* $2^{nd}$ Edition, McGraw-Hill Book Co., copyright 1958, which is hereby incorporated herein by reference. Such techniques have not previously been applied in high frequency electronics applications. A feedthrough center conductor 160 is bonded within the dielectric 158 using a vacuum tight sealing method.

The feedthrough 124 may be attached to the dewar housing 64 in a manner providing a vacuum tight seal between the body 152 and the housing 64, via, for example, electron beam welding, laser welding, or other known suitable methods. The body 152 of the receptacle 122 may be provided with a groove 162 to facilitate welding of the feedthrough 124 to the wall of the dewar housing 64. Suitable sealing methods are well-known in the art and therefore, they are not described in detail herein. In a preferred embodiment, the feedthrough 124 has a leak rate of less than $1.0\times10^{-14}$ cc/second for Helium.

As with the threaded connectors 50 and 55 described above, the components of the push-on connector 120 are configured to be impedance matched to the cryocables 10 and 100, the transition 20, and the feedthrough 124, as the case may be. This may be accomplished by approximately matching the ratios of the diameters of the respective conductors and dielectrics at each of the interfaces between the push-on connector 120, the cryocables 10 and 100, and the feedthrough 124. For example, at the interface between the push-on connector 120 and the feedthrough 124, the diameter of the dielectric 144 of the connector 120 should be larger than the diameter of the dielectric 158 of the feedthrough 124 because the spring contact 148 has a larger diameter than the feedthrough center conductor 160.

The method of connecting the push-on connector 120 to the receptacle 122 and feedthrough 124 is quite simple. The lip 132 of the locking portion 128 of the connector 120 is first aligned with the lead-in chamfer 154 of the receptacle 122. As the connector 120 is pushed into the receptacle 122, the lead-in chamfer 154 forces the flexible detents 130 inward, thereby allowing the connector 120 to be further inserted. As the connector 120 is further inserted, the spring contact 148 receives the feedthrough center conductor 160. Upon full insertion, the raised lip 132 reaches the recess 134 and the detents 130 expand outward radially such that the raised lip 132 locks into the recess 134 as shown in FIG. 22. The connector is disconnected by simply pulling the connector 120 out of the receptacle 122.

While embodiments of the present invention have been shown and described, various modifications may be made without departing from the scope of the present invention, and all such modifications and equivalents are intended to be covered.

What is claimed is:

1. A push-on connector for a cryocable, comprising:

a cylindrical outer shell having a proximal and distal end, said outer shell being electrically conductive;

a plurality of flexible detents disposed on said proximal end of said outer shell, said plurality of detents defining a raised lip;

a cable connection disposed on said distal end of said outer shell, said cable connection being adapted to connect to the cryocable, said cable connection being defined by a solid section of a cylinder cut below the central axis of the cylinder and thereby creating a flat surface;

a dielectric having proximal and distal ends, said dielectric housed within said cylindrical outer shell, said dielectric having an axial bore; and a center conductor received within said axial bore of said dielectric, said center conductor extending substantially from said proximal end of said outer shell to beyond said distal end of said dielectric, thereby providing a pin.

2. The connector of claim 1 wherein said center conductor includes a spring contact electrically connected thereto.

3. The connector of claim 1 wherein said plurality of detents comprise a flared cylinder having a plurality of longitudinal slots.

4. The connector of claim 1 wherein said pin is free of any surrounding dielectric, said pin extending over said flat surface of said cable connection.

5. A push-on connector for a cryocable, comprising:

a connector body having a proximal and distal end;

an outer shell connected to said connector body, said outer shell being electrically conductive;

a receptacle connector for mechanically and electrically disconnectably connecting said connector to a mating receptacle, said receptacle connector disposed on said distal end of said body;

a cryocable connector for connecting the receptacle connector to the cryocable, said cryocable connector disposed on said distal end of said body;

a dielectric having proximal and distal ends, said dielectric housed within said body, said dielectric having an axial bore; and a center conductor received within said axial bore of said dielectric, said center conductor extending substantially from said proximal end of said outer shell to beyond said distal end of said dielectric, thereby providing a pin.

6. The connector of claim 5 wherein said pin is free of any surrounding dielectric, said pin extending over said flat surface of said cable connection.

7. The connector of claim 5 wherein said body is cylindrical in shape.

8. The connector of claim 5 wherein said cryocable connector is defined by a solid section of a cylinder cut below the central axis of the cylinder and thereby creating a flat surface.

9. The connector of claim 5 wherein said receptacle connector comprises a flared cylinder having a plurality of longitudinal slots.

10. A cryocable connector system comprising:

a push-on connector comprising:

a cylindrical outer shell having a proximal and distal end, said outer shell being electrically conductive;

a plurality of flexible detents disposed on said proximal end of said outer shell, said plurality of detents defining a raised lip;

a cable connection disposed on said distal end of said outer shell, said cable connection being adapted to connect to the cryocable;

a dielectric having proximal and distal ends, said dielectric housed within said cylindrical outer shell, said dielectric having an axial bore; and a center conductor received within said axial bore of said dielectric, said center conductor extending from said proximal end of said outer shell to beyond said distal end of said dielectric; and a feedthrough adapted to mechanically and electrically mate with said push-on connector comprising:

an electrically conductive body having a substantially cylindrical cavity adapted to receive said detents and having a recess shaped to receive said raised lip;

a feedthrough dielectric bonded within the body and providing a vacuum tight seal between the dielectric and the body; and a feedthrough center conductor bonded within said feedthrough dielectric and extending longitudinally through said dielectric and providing a vacuum tight seal between said feedthrough center conductor and said feedthrough dielectric.

11. The system of claim 10 wherein said body of said feedthrough has an annular groove near a surface of said body adapted to be welded to a wall of a vacuum dewar.

12. The system of claim 10 wherein said center conductor which extends beyond said distal end of said dielectric defines a pin.

13. The system of claim 12 wherein both said vacuum tight seal between said feedthrough center conductor and said feedthrough dielectric and said vacuum tight seal between said dielectric and said body have leak rates of less than $1.0\times10^{-14}$ cc/second for Helium.

14. The system of claim 13 wherein said push-on connector and said feedthrough are approximately impedance matched.

15. The system of claim 10 wherein said plurality of detents comprise a flared cylinder having a plurality of longitudinal slots.

16. The system of claim 10 wherein said cable connection is defined by a solid section of a cylinder cut below the central axis of the cylinder and thereby creating a flat surface.

17. The system of claim 16 wherein said pin is free of any surrounding dielectric, said pin extending over said flat surface of said cable connection.

18. The system of claim 16 wherein said center conductor includes a spring contact electrically connected thereto.

* * * * *

UNITED STATES PATENT AND TRADEMARK OFFICE

CERTIFICATE OF CORRECTION

PATENT NO. : 6,154,103
DATED : November 28, 2000
INVENTOR(S) : Scharen et al.

It is certified that error appears in the above-identified patent and that said Letters Patent is hereby corrected as shown below:

Drawings,
FIGS, please substitute FIG. 22 with the attached FIG. 22.

Column 5,
Line 28, change “feed-through” to -- feedthrough --.

Column 7,
Line 3, change “co-planar” to -- coplanar --.

Column 8,
Line 22, (Table 2, line 1) change “SPCW*” to -- SPCW** --.

Column 12,
Lines 27 and 31, change “feed through” to -- feedthrough --.
Line 62, after “electron beam” please add the following text -- , TIG (tungsten inert gas) --.

Column 14,
Line 62, change “FIG.” to -- FIGS. --.

Column 15,
Line 19, change “82” to -- 144 --.
Line 30, change “90” to -- 150 --.
Line 33, change “cryocable 13” to -- cryocable 10 --.
Line 54, after “detents 130” add -- (shown in FIGS. 20 and 21A) --.

UNITED STATES PATENT AND TRADEMARK OFFICE

CERTIFICATE OF CORRECTION

PATENT NO. : 6,154,103
DATED : November 28, 2000
INVENTOR(S) : Scharen et al.

It is certified that error appears in the above-identified patent and that said Letters Patent is hereby corrected as shown below:

Column 18,
Line 3, delete "and".
Line 31, change "$^{-14}$" to -- $^{-12}$ --.

Signed and Sealed this

Seventeenth Day of December, 2002

JAMES E. ROGAN
*Director of the United States Patent and Trademark Office*